United States Patent [19]

Blank et al.

[11] 4,090,377

[45] May 23, 1978

[54] CIRCULAR KNITTING MACHINE

[75] Inventors: Jochen Blank, Hebsack; Günter Glück, Stetten, Fildern, both of Germany

[73] Assignee: C. Terrot Soehne GmbH. & Co., Stuttgart, Germany

[21] Appl. No.: 704,967

[22] Filed: Jul. 13, 1976

[30] Foreign Application Priority Data

Jul. 18, 1975 Germany ..... 2532135

[51] Int. Cl.[2] ..... D04B 15/66; D04B 15/78

[52] U.S. Cl. ..... 66/154 A; 66/50 R

[58] Field of Search ..... 66/50 R, 50 B, 25, 154 A

[56] References Cited

U.S. PATENT DOCUMENTS

| | | | |
|---|---|---|---|
| 3,470,714 | 10/1969 | Corbaz | 66/50 R |
| 3,561,232 | 2/1971 | Stock et al. | 66/50 R |
| 3,807,196 | 4/1974 | Gottsching | 66/50 R |
| 3,896,638 | 7/1975 | Gottschall et al. | 66/50 R |
| 4,004,439 | 1/1977 | Farmer et al. | 66/50 R X |
| 4,031,718 | 6/1977 | Luth | 66/154 A |

FOREIGN PATENT DOCUMENTS

| | | | |
|---|---|---|---|
| 2,026,584 | 12/1971 | Germany | 66/50 R |

*Primary Examiner*—Wm. Carter Reynolds

[57] ABSTRACT

An arrangement for producing synchronization pulses for pattern control of the knitting needles of a circular knitting machine. The arrangement includes a plurality of control units mounted on, for example, the cam housing, which units coact with the butts of the knitting needles mounted on the needle cylinder. The number of control units per knitting system is equal to (*n*) which corresponds to the number of different types of selector elements. A raster system, forming part of a ring which rotates with the needle cylinder, coacts with a pick-up unit mounted on the cam housing. The pick-up unit includes a plurality of pick elements which emit signals in accordance with the scanning of the raster system. When the needle cylinder rotates normally, a series of code signals are cyclically produced and logically combined in the sense of a logic AND circuit by means of a read out control unit which ensures this cyclic sequence of signals even if the needle cylinder comes to a standstill or rotates slighly in a reverse direction.

11 Claims, 9 Drawing Figures

CIRCULAR KNITTING MACHINE

The invention relates to a multi-system circular knitting machine with pattern control means and two machine parts which are rotatable relative to each other, of which a first part contains selector elements, which can be controlled in accordance with the pattern, and a second part contains control units adapted to act on said selector elements, synchronization of the pattern control means with the rotating motion of the two machine parts being obtained by one of the said machine parts being coupled to raster system and the other machine part being coupled to a tracer element system which is adapted to trace the raster system, said tracer element system incorporating a tracer element for producing a timing signal which traces a raster associated with the raster system and has a pitch which corresponds to that of the first machine part, and with other tracer elements which are associated with the tracer element system and produce cyclically consecutive code signals on the control units in accordance with the normal direction of rotation of the machine parts and in accordance with the traversing motion of selector elements, said code signals being logically combined with the timing signals in the sense of a logic AND circuit.

In a known circular knitting machine of this kind (German Offenlegungsschrift No. 2,129,951), the needle cylinder forms the first machine part and control units, for example in the form of known electromagnets, control the needles in accordance with the pattern, the needles forming the selector elements. The needle cylinder, associated with two tracer elements for producing the code signals, is coupled to a slotted disc through a transmission which is theoretically phase-rigid. The said two tracer elements are phase-displaced by 90° with respect to each other — in terms of the slot distance of the slotted disc - and the code signals delivered by the two tracer elements are compared in a comparator with expected code signals delivered by a counter so as to suppress the call up of pattern control signals from a pattern programme store if the needle cylinder does not rotate in the specified direction of rotation — this can occur during the run-out phase of a circular knitting machine when the needle cylinder performs oscillating motion immediately before coming to a stop. In the known circular knitting machine the needle cylinder itself is also provided with a tracer element which traces the webs between the needle ducts and thus produces a timing signal. This is combined through logic AND-circuits with the outputs of the pattern programme store so that current is applied to the control magnets connected to the outputs of the said AND-circuits, always at the right moment the German Offenlegungsschrift No. 2,129,951 also describes a modification of the previously described construction in accordance with which the slotted disc is replaced by a disc which rotates in synchronism with the needle cylinder and contains several mutually offset rows of markings to function as a raster, the said rows being then traced by tracer elements which are not phase-displaced with respect to each other.

There is no doubt that the construction of the previously described known knitting machine is relatively complicated and the machine suffers from the disadvantage that in practice there are no transmission systems with complet phase rigidity between needle cylinder and disc for producing the code signals. Another serious disadvantage of the known construction is due to the fact that all tracer elements must be individually and accurately adjusted, a feature which is time-consuming and therefore costly both in assembling a new circular knitting machine as well as when maintaining machines and when fitting replacement parts.

It was the object of the invention to improve a circular knitting machine of the kind described hereinbefore in such a way as to call for less time for assembling and adjusting components required for synchronizing the pattern control with the needle cylinder, a ribbed disc or the like.

Accordng to the invention, this problem can be solved in that all rasters of the raster system are non-rotationally connected to the first machine part and that all tracer elements are attached to a common carrier which is fixedly connected to the second machine part but is adjustable in the direction of rotation. In the course of assembling the separately produced tracer element system the different tracer elements are exactly adjusted relative to each other, which is readily possible by means of gauges. When the tracer element system is installed into a circular knitting machine it is then merely necessary to adjust a single part with respect to the tracer system, namely the single carrier which is common to all tracer elements, and since the code signals are cut out by the timing signal with the aid of the AND-circuit it is sufficient to confine precise adjustment to the timing signal-producing tracer element with respect to the raster associated therewith. The construction according to the invention does not therefore depend on any particular precision of the relative arrangement of the tracer elements for producing the code signals and of the tracer element which produces the timing signal. To achieve the previously mentioned advantages it is essential that all rasters are fixedly connected to one machine part, for example the needle cylinder, but this does not mean that all rasters must necessarily be disposed on a single component or that this component must be part of the needle cylinder. Moreover, it will be obvious that a circular knitting machine according to the invention can be constructed in a much simpler manner than the known construction which was explained previously because it is possible to dispense wih the transmission which in any case does not provide phase rigidity.

The basic idea of the invention is particularly suitable when applied to circular knitting machines in which the first machine part, i.e. the needle cylinder, is provided with a cyclic sequence of different kinds of selector elements (for example, needles) and the second machine part (for example, the machine frame) is provided for each knitting system with a number of control units which corresponds to the number ($n$) of selector element kinds. To drive the control units in the correct sequence in this case, the construction according to the invention is further developed in that the other tracer elements for producing the code signals are arranged one behind the other in the direction of rotation and their number corresponds to the number ($n$) of the selector element kinds and that the raster system — as already known from the German Offenlegungsschrift No. 2,129,951 — is provided not only with the first raster for producing the timing signal but also with a second raster associated with the second tracer elements, the pitch of the second raster being equal to that of the first raster divided by the number ($n$) of the selector element kinds. If the spacing between the second tracer elements are correctly selected they will produce a cyclic sequence of code signals for driving the control units. Synchronization of the pattern control means can therefore be achieved without any additional costs even in circular knitting machines with different kinds of selector elements and a corresponding number of control units for each knitting system.

A particularly simple raster system which is not prone to trouble has the following construction: the first raster is formed by a ring of slots which extend approximately perpendicularly to the direction of rotation, each $n^{th}$ being longer than the intermediately disposed slots so that the totality of the $n^{th}$ slots form the second raster. It would also be possible for the length of the needle ducts of a needle cylinder to be simply different in the downward direction.

In a preferred embodiment of the circular knitting machine according to the invention, the carrier for the tracer elements is mounted fixedly with respect to the frame and the raster system is situated on a ring plate which extends away from the rotating first machine part (i.e. the needle cylinder) in the radial direction. This not merely offers the advantage that the signals produced by the tracer elements need not be transmitted from a rotating machine part to stationary components of the circular knitting machine, but tracing of the raster gives rise to lesser problems because of the increasing distances between the raster elements with an increasing radius, for example if tracing is performed on a needle cylinder which usuall has a very narrow pitch.

If the carrier for the tracer elements is rotatable and adjustable about an axis which extends approximately perpendicularly from the surface formed by the raster system, the phase of the second tracer elements for producing the code signals relating to the tracer elements which produce the timing signal can be altered simply by rotation of the common carrier.

It is particularly convenient to construct the tracer elements as field plates, more particularly as differential field plates, which are disposed on at least one permanent magnet because the raster system can then simply comprise a ferromagnetic machine part and because differential field plates are relatively insensitive to the effects of temperature and other fluctuations. It is advantageous to employ magnets containing rare earths, more particularly cobalt-samarium magnets, for example of the kind which can be obtained from Vacuumschmelze Hanau under the description "Vacumax". Permanent magnets of this kind have an exceptionally large energy content and are therefore substantially smaller than the conventional Alnico magents.

A particularly simple but nevertheless accurate mode o attachment of the tracer elements to the common carrier can be obtained when the latter is constructed as a rod on one of whose endfaces the tracer elements are mounted and if the said endface is provided with a stop to function as abutment for the permanent magnet or for the permanent magnets of the field plates. After the field plates are secured to the common carrier, it is advisable to embed the tracer elements in an encapsulating compound, more particularly into casting resin, so that the member formed by this compound is flush with the front surface of the carrier which adjoins the step.

The invention therefore permits the separate construction with a high degree of accuracy of a relatively small component, namely the tracer element system, so that this need merely be subsequently adjusted and attached in its entirety to the circular knitting machine.

Further features, advantages and details of the invention are disclosed in the annexed claims and/or in the description hereinbelow and in the annexed drawing of a preferred embodiment of a circular knitting machine according to the invention; in the drawing:

Figure 1:
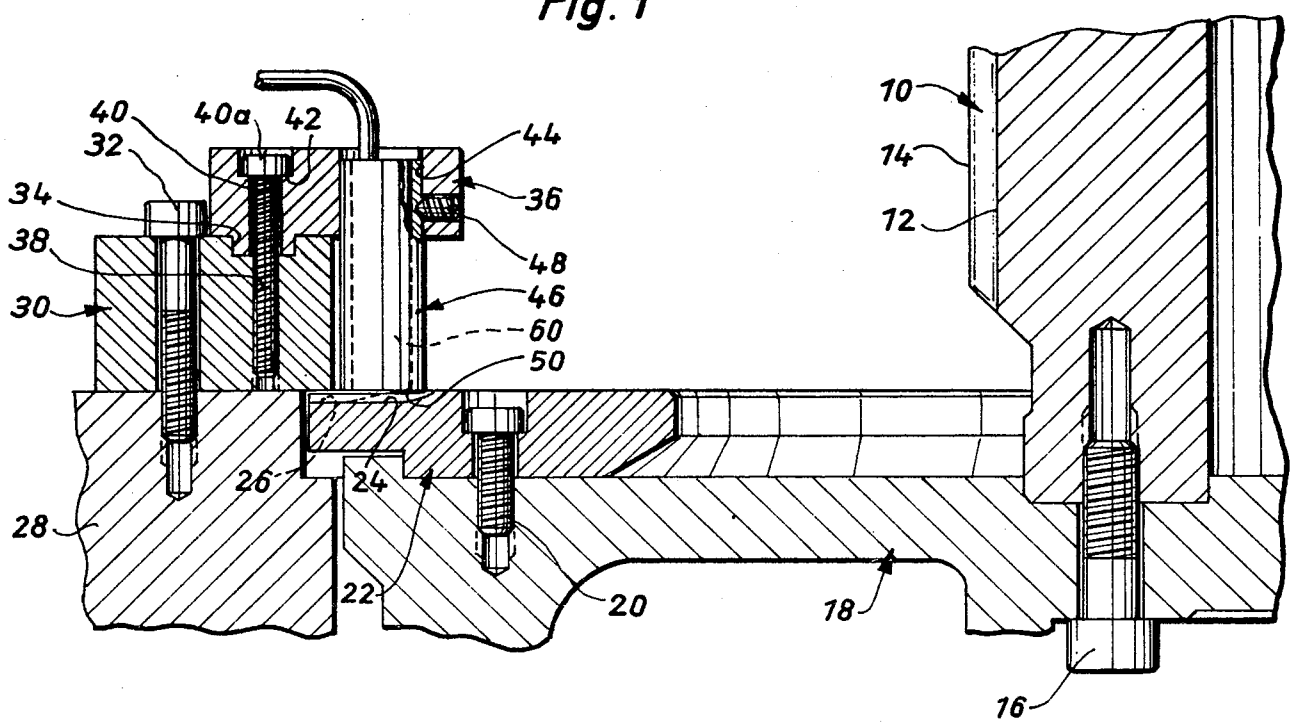
FIG. 1 is an axial section through the bottom part of a needle cylinder and through the parts surrounding the same.

FIG. 1 discloses a needle cylinder, referenced in its entirety by the numeral 10, the circumference of which is provided with needle ducts 12 extending in the axial direction and with webs 14 disposed between the said ducts. The needle cylinder is mounted by means of screw fasteners 16 on a socalled cylinder carrier ring 18 through which the needle cylinder is driver. A ring plate 22, the top of which is provided with a raster system comprising slots 24 and 26, is mounted by means of screw fasteners 20 on the said cylinder carrier ring.

A bearing pedestal 30 is mounted by means of screw fasteners 32 on a plate 28 of the machine frame which is not shown in detail. The said bearing pedestal incorporates a guide slot 34 which extends perpendicularly to the plane of the drawing and therefore in the direction of the tangent to the ring plate 22, a holder, referenced in its entirety by the numeral 36, being supported in the said guide slot 34. The bearing pedestal 30 is provided with tapped holes 38 into which are screwmounted screw fasteners 40 that extend through the holder 36. A slot instead of a bore can be provided in the holder 36 for the screw fasteners 40 to enable the holder 36 to be displaced perpendicularly to the plane of the drawing within the guide slot 34, since the said holder is in any case tightened against the bearing pedestal 30 through a shoulder 42 and through the screw head 40*a*.

In a bore 44 which extends perpendicularly to the plane of the ring plate 22 the holder 36 supports a tracer which is referenced in its entirety by the numeral 46 and is fixed in the bore 44 by means of a grub screw 48. The bottom endface of the said tracer is referenced by the numeral 50. Different tracer elements are recessed into the said bottom endface but these will be described subsequently and they are provided for tracing the raster system on the ring plate 22.

Figure 2:
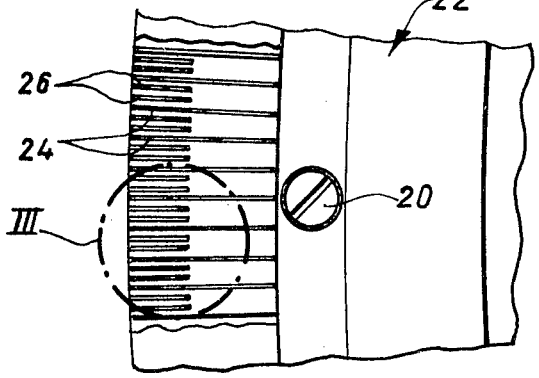
FIG. 2 is a plan view of a section of the raster system according to the invention.
Figure 3:
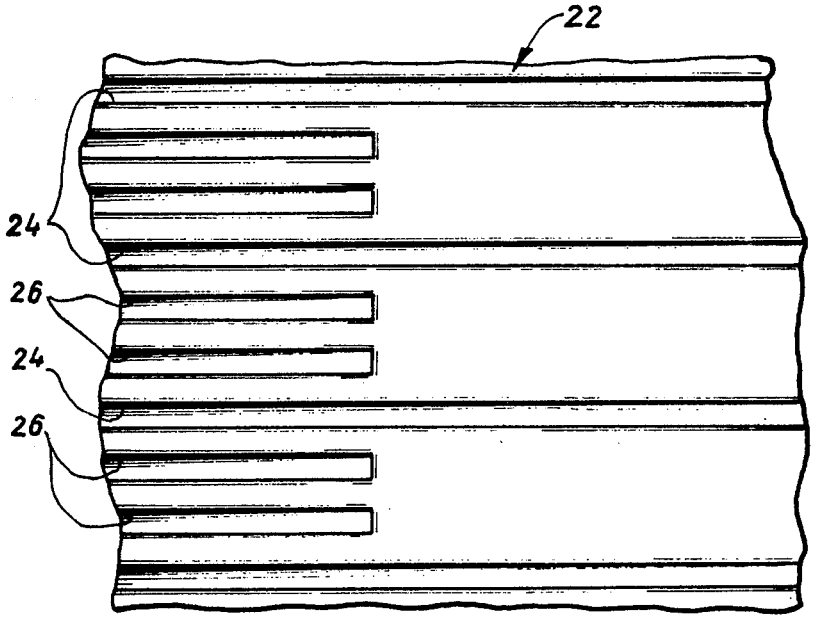
FIG. 3 shows the encircleb area III of FIG. 2 to an enlarged scale.

FIGS. 2 and 3 disclose that two short slots 26 follow each long slot 24 in the raster system because the needle ducts 12 of the needle cylinder in this embodiment accommodate three different kinds of needles, the different needle kinds following each other cyclically in the circumferential direction of the needle cylinder. Accordingly, three different control units in the form of electromagnets, not shown, are provided for each knitting system of this circular knitting machine, each of the said electromagnets acting on a specific kind of needle. As will be shown subsequently, the raster system according to FIGS. 2 and 3 produces three code signals which are offset with respect to time and with which the three control units of each knitting system are driven.

The angular spacings between the middle of the slots 24 and 26 correspond to the angular spacings between the webs 14 or between the needle ducts 12 of the needle cylinder 10 so that the slots pass by the tracer 46 at the same timing as the needle ducts or the needles on the control units of the knitting systems.

Figure 9:
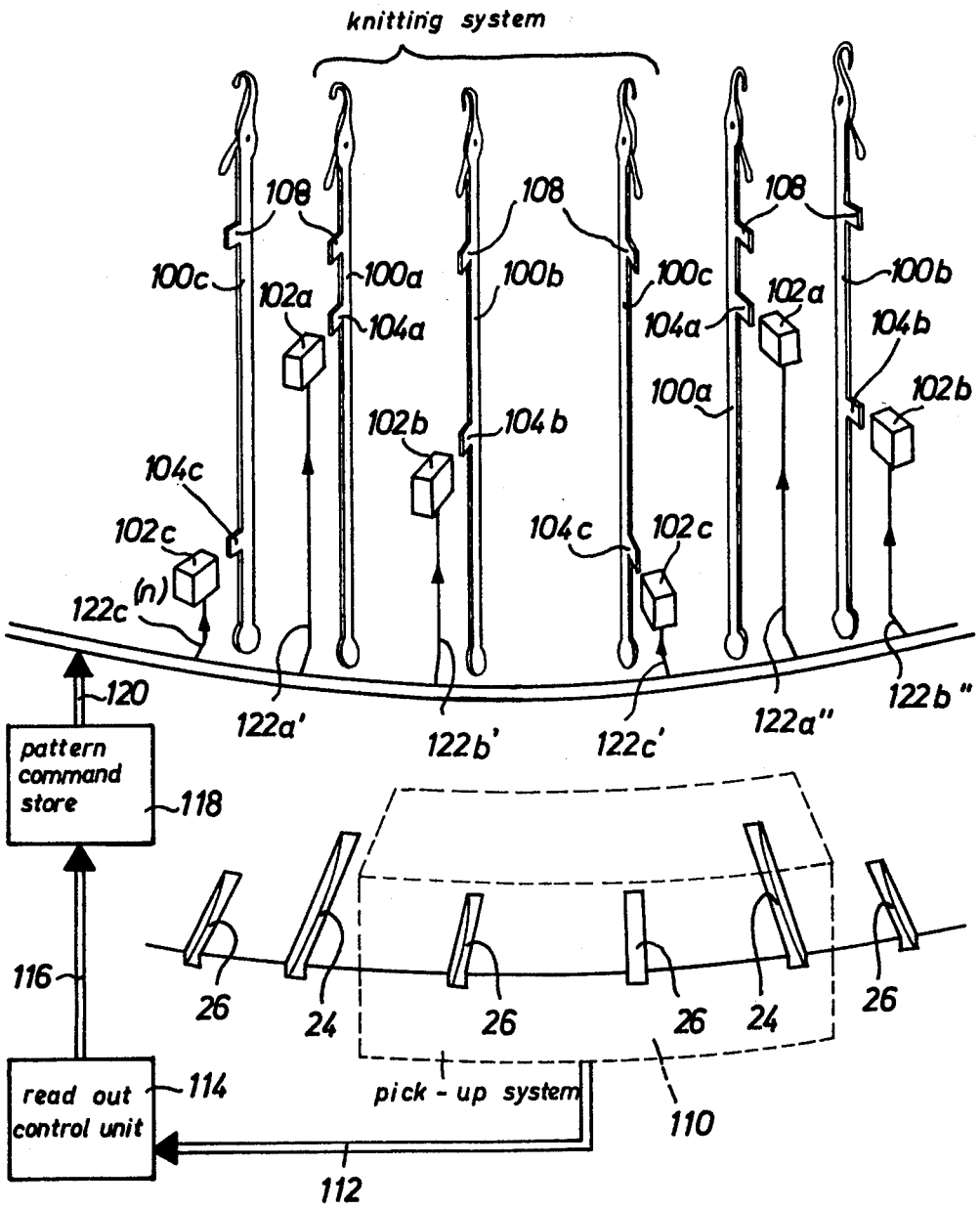
FIG. 9 is a schematic perspective view illustrating various components of the arrangement of the invention.

FIG. 9 illustrates the cylinder needles of the knitting machine which are slidably mounted in the needle ducts 12 of the needle cylinder 10. In the illustrated embodiment the needle cylinder 10 operatively supports three different types of knitting needles 100*a*, 100*b* and 100*c* which are adapted to be pivoted about their lower ends so that their upper portions move radially outward. These pivoting movements of the cylinder needles are effected via the magnetic forces exerted respectively by the electromagnets 102*a*, 102*b* and 102*c*. Each system of the circular knitting machine includes a set of such electromagnets. The electromagnets can, for example, be mounted in a non-illustrated cam housing. If, for example, the electromagnet 102*b* is momentarily energized by a current pulse, when a knitting needle of the type 100*b* passes by it, then this needle is swung radially outwardly so that a butt 108 thereof coacts with the conventional cam portions (not illustrated) in the cam housing and thereby lifts the needle into a knitting position.

The slits 24, 26 (which are also illustrated in FIGS. 1 and 3) in FIG. 9 are scanned by a pick-up or scanning system 110 which, subsequent to the scanning, outpulses three code-signals A, B and C as well as a clock signal T and conducts these signals via multi-channel conduit 112 to a read out control unit 14 which in turn controls via a multi-channel conduit 116 a pattern command store 118. The control of the pattern command store 118 is effected in such a way that the individual storage locations of the command store 18 are cyclically read one after the other in synchronization with the clock signal T in order to transmit pattern command signals to the electromagnets 102*a*, 102*b* and 102*c*. The cyclic scanning or picking up of pattern command signals from a storage unit with the aid of clock signals and code signals forms part of the state of the art and is disclosed, for example, in U.S. Pat. No. 3,896,638. Therefore, a detailed description of this portion of the control circuit has been omitted. The manner in which the individual pattern command signals are conducted to the individual electromagnets forms also part of the state of the art. Therefore, there is merely illustrated in FIG. 9 a multi-channel conduit 120, branch conduits 122*a*', 122*b*', 122*c*' of which respectively conduct command pulses to the electromagnets 102*a*, 102*b* and 102*c* of a first knitting system, branch conduits 122*a*'', 122*b*'', 122*c*'' of which respectively conduct command pulses to the electromagnets of a second knitting system. . . and branch conduits $122a^{(n)}$, $122b^{(n)}$, $122c^{(n)}$ of which respectively conduct command pulses to the electromagnets of an $n^{th}$ knitting system.

In the circular knitting machine of this invention, the read out control unit 114 ensures that the code signals are cyclically outpulsed in accordance with the normal rotary motion of the needle cylinder and such outpulsing can occur only in this manner even then when the needle cylinder rotates a small distance in the opposite rotary direction, which may sometimes occur when the needle cylinder of the circular knitting machine is brought to a standstill.

The aforedescribed code signals, which are hereinafter designated as $A_1$, $B_1$ and $C_1$ and by which pattern command signals are outpulsed from the pattern command store 118 in accordance with the code signals received via the conduit 116, always appear in the cyclic sequence $A_1$, $B_1$, $C_1$, $A_1$, $B_1$, $C_1$, $A_1$. . This result is obtained by means of the circuit illustrated in FIG. 7 which will be described hereinbelow.

Figure 4:
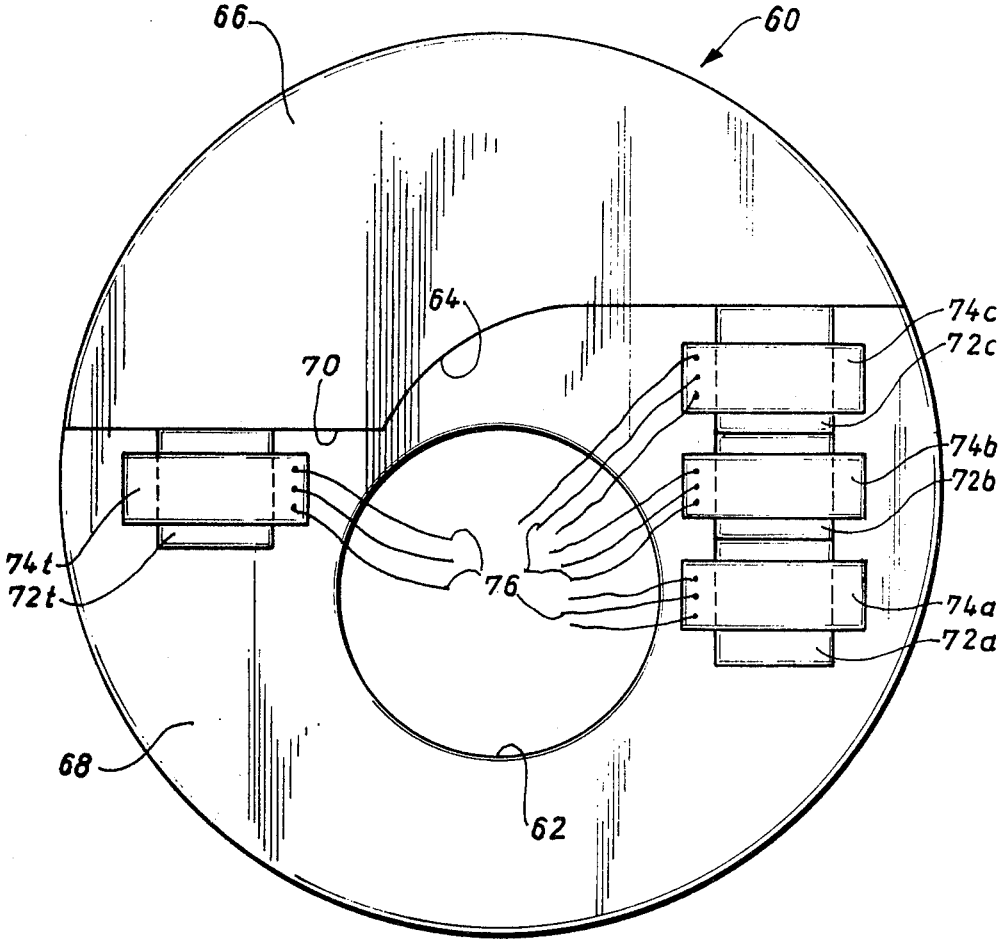
FIG. 4 is a plan view of the carrier endface nearest to the raster system.

FIG. 4 is a plan view of the bottom endface 50 of the tracer 46. This is provided with a carrier 60 in the form of a circular rod of non-magnetic material, for example brass, and said circular rod is provided with a longitudinal bore 62. The bottom end of the carrier 60 forms a step 64 so that the endface region associated with the carrier 60 and designated with the numeral 66 in FIG. 4 extends further forward or downward than the endface region 68; an abutment surface 70 is formed between the said two endface regions.

Three permanent magnets 72*a*, 72*b* and 72*c*, formed as small plates and bearing upon each other or against the abutment surface 70, are adhesively attached adjacently to each other on the endface region 68. A field plate 74*a* or 74*b* or 74*c* is secured to each of the said permanent magnets, more particularly by adhesive joining, and the said field plates are known differential field plates, for example of the Type FP110L60 by Siemens AG. Munich, West Germany. A further permanent magnet 72*t*, which supports a field plate 74*t*, is mounted in like manner on the endface region 68 on the far side of the longitudinal bore 62. The permanent magnet 72*t* also bears upon the abutment surface 70 the configuration of which is such that the field plate 74*t* assumes the correct position in relation to the field plates 74*a* to 74*c* — in the transverse direction according to FIG. 4. Advantageously, the height of the step 64 is so dimensioned and adapted to the thickness of the permanent magnets and of the field plates that the surfaces of the latter are situated only slightly below the level of the endface region 66. As indicated in FIG. 4, connecting leads 76 of the field plates extend to the longitudinal bore 62.

After the permanent magnets and the field plates are assembled the longitudinal bore 62 and the space above the endface region 68 to the level of the endface region 66 are filled with an encapsulating compound, more particularly encapsulating resin, so that the permanent magnets and the field plates are embedded in the encapsulating compound. It should be added that the permanent magnets are polarized perpendicularly to the plane of the drawing in FIG. 4.

The tracer 46 is mounted above the raster system of the ring plate 26 so that all slots 24, 26 pass beneath the field plate 74*t*, while the field plates 74*a* to 74*c* are situated above that region of the ring plate 22 into which the long slots 24 but not the short slots 26 extend. Furthermore, the transverse spacings between field plates 74*a*, 74*b* and 74*c* are dimensioned so that they can produce the code signals A to C illustrated in lines 3 to 5 of FIG. 8, i.e. the spacings between the field plate centers correspond to the spacings between the centers of the slots 24, 26. The timing signal in line 1 of FIG. 8 can be produced by means of the field plate 74*t*.

Figure 5:
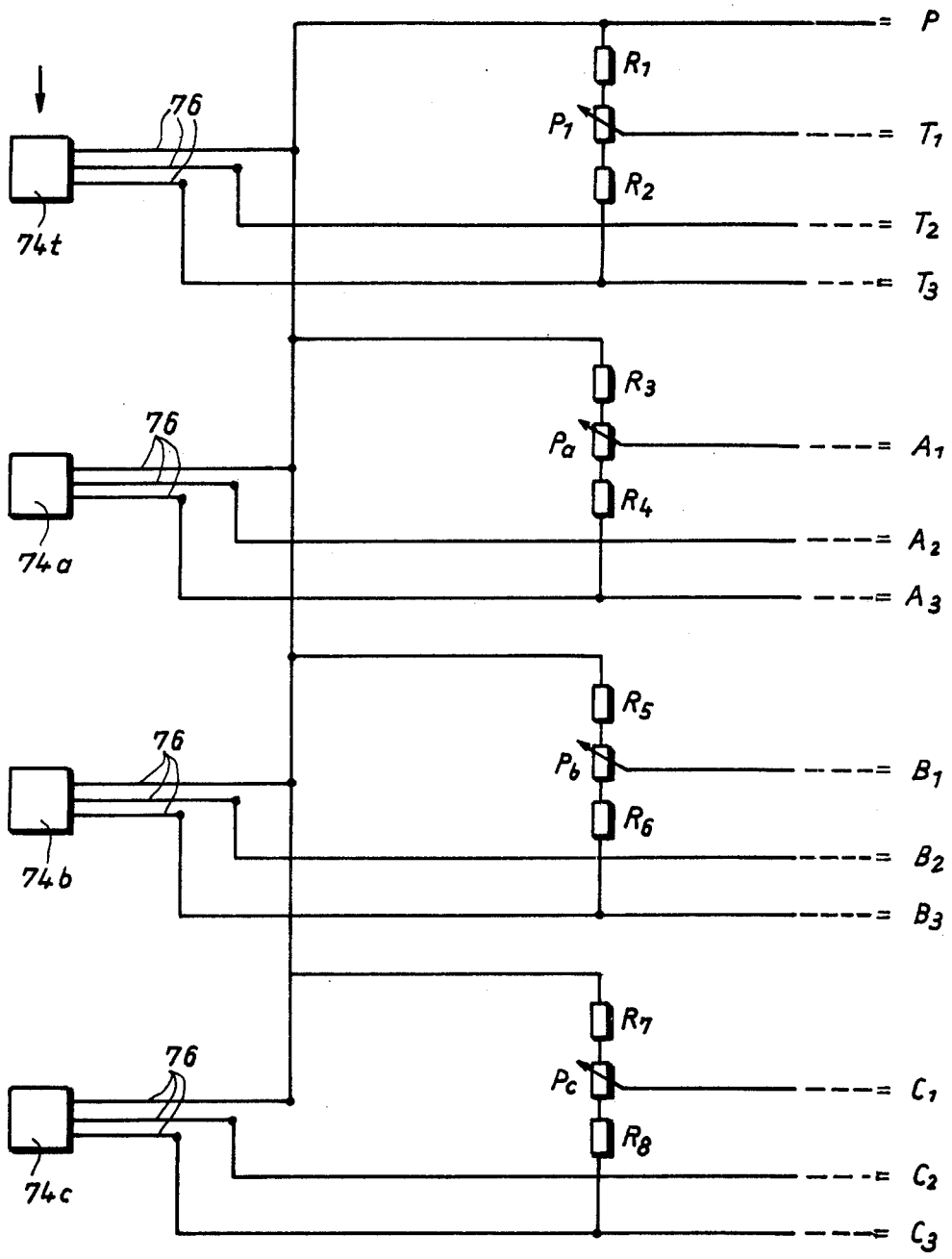
FIGS. 5 to 7 show parts of the circuit for evaluating the signals delivered by the tracer elements.

FIG. 5 shows that each of the field plates 74*a* to 74*c* is incorporated into a bridge circuit, namely by means of the field plate leads, all of which are designated with the numeral 76. In addition to containing the field plate 74*t*, the bridge circuit of said field plate also includes the resistors $R_1$ and $R_2$ as well as a potentiometer $P_1$, the bridge circuit for the field plate 74a comprises resistors $R_3$ and $R_4$ and a potentiometer $P_a$, the bridge circuit for the field plate 74b incorporates resistors $R_5$ and $R_6$ as well as a potentiometer $P_b$ and the bridge circuit for the field plate 74c incorporates resistors $R_7$ and $R_8$ as well as a potentiometer $P_c$. The configuration of the wiring requires no further description because it is cleary shown in FIG. 5.

As already mentioned, the field plates are of the differential kind which are symmetrical to each of the middle of the three connecting leads 76. The purpose of the permanent magnets 72a to 72c and 72t, not shown in FIG. 5, is to provide magnetic bias for the differential field plates.

Figure 8:
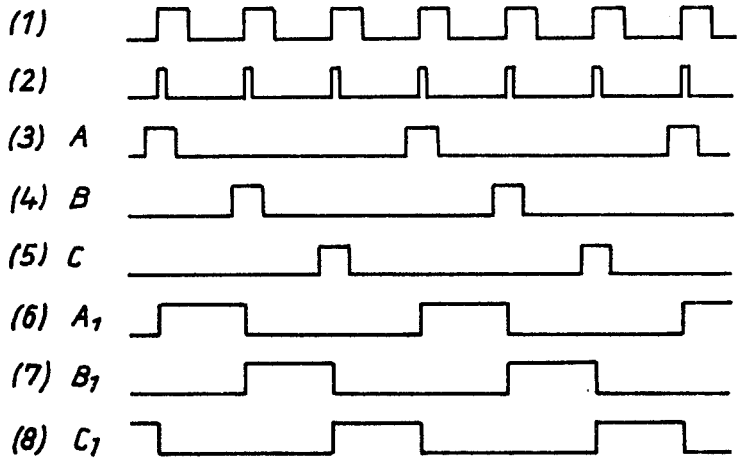
FIG. 8 is a pulse diagram relating to FIGS. 6 and 7.
Figure 6:
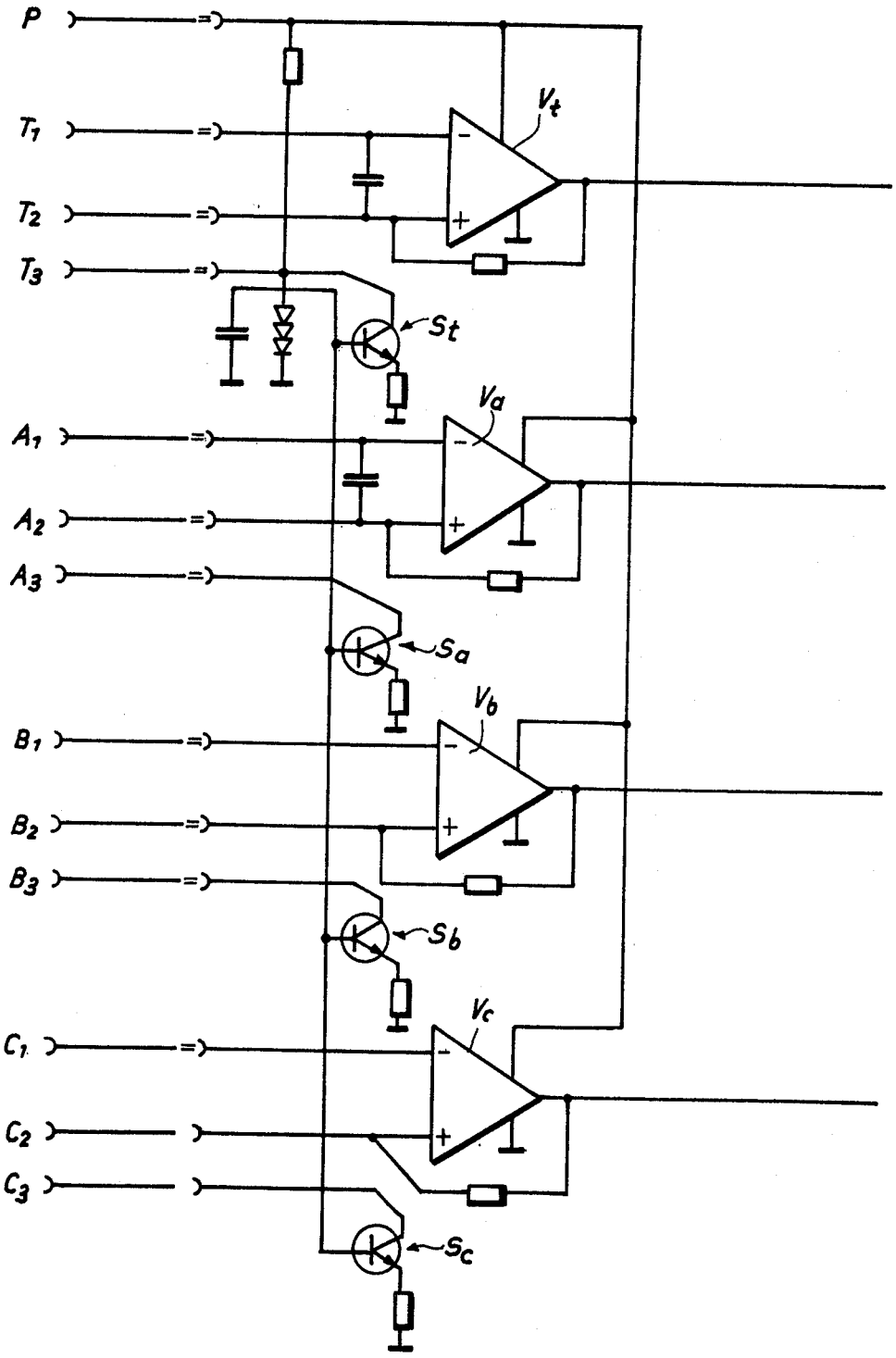

All of the parts of the circuit shown in FIG. 5 are advantageously accommodated in the tracer 46 and the partial circuit according to FIG. 5 terminates on a multiple-pin plug connector with the connection P for a positive dc voltage, $T_1$ to $T_3$ for the field plate 74t, connections $A_1$ to $A_3$ for the field plate 74a, $B_1$ to $B_3$ for the field plate 74b and $C_1$ to $C_3$ for the field plate 74c. The differential field plates can be symmetrical with each other by means of the potentiometers $P_1$ and $P_a$ to $P_c$. The widths of the signal halfwaves delivered by the field plates and therefore the pulse widths can also be varied and adjusted by means of the potentiometers. The purpose of the partial circuit shown in FIG. 6 is to convert the sinusoidal output signals delivered by the field plates into square-wave signals as shown in FIG. 8. The inputs of the partial circuit according to FIG. 6 have the same reference numerals as the outputs of the partial circuit according to FIG. 5 and not all circuit elements will be described since details of the partial circuit according to FIG. 6 are not the subject of the invention. It is sufficient to point out that constant-current sources $S_t$, $S_a$, $S_b$ and $S_c$ are provided to stabilize the current which flows through each bridge circuit and operations amplifiers $V_t$, $V_a$, $V_b$ and $V_c$ convert the sinusoidal output signals of the field plates into the square-wave signals according to lines 1, 3, 4 and 5 of FIG. 8. The said square-wave signals will be described hereinbelow as timing signal or as code signals A, B and C.

Figure 7:
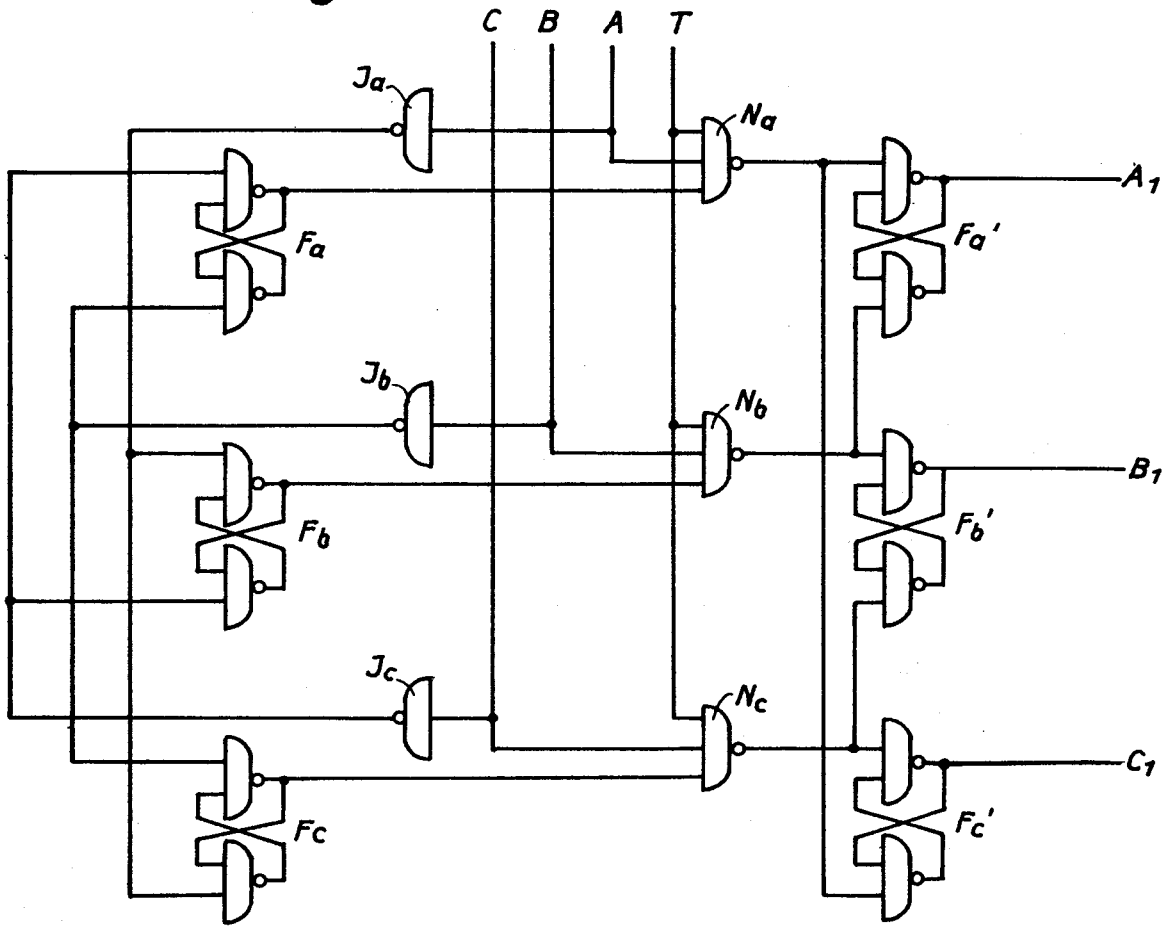

FIG. 7 finally shows a partial circuit by means of which the timing signal and the code signals A to C are logically linked to each other so that code signals $A_1$, $B_1$ and $C_1$, associated with the code signals A to C and forming the output signals of the partial circuit according to FIG. 7, always occur in cyclic sequence thus suppressing errors in pattern control due to rotary oscillations of the needle cylinders during the run-out motion, i.e. when the circular knitting machine is shut down.

The partial circuit according to FIG. 7 with the inputs for the timing signal T and the code signals A, B and C comprises three inverters $I_a$, $I_b$ and $I_c$, three RS flip-flop circuits $F_a$, $F_b$ and $F_c$, three NAND-circuits $N_a$, $N_b$ and $N_c$ and three additional resetting flip-flop circuits $F'_a$, $F'_b$ and $F'_c$. Each of the resetting flip-flop circuits comprises two NAND-circuits and the outputs of the resetting flip-flop circuits $F'_a$, $F'_b$ and $F'_c$ supply the code signals $A_1$, $B_1$ and $C_1$ in accordance with lines 6 to 8 of FIG. 8.

The method of operation of the partial circuit according to FIG. 7 is as follows:

If a code signal A occurs, a logic O-signal will appear at the output of the inverter $I_a$ and the flip-flop circuit $F_b$ is set or prepared so that a logic 1-signal appears at its output. The flip-flop circuit $F_c$ is simultaneously reset or driven to cut-off so that a logic O-signal appears at its output.

If a code signal B then occurs, a logic O-signal will appear at the output of the inverter $I_b$ and the flip-flop circuit $F_a$ will be reset or driven to cut-off so that a logic O-signal appears at its output. The flip-flop circuit $F_c$ is simultaneously set or prepared so that a logic 1-signal appears at its output. It should be pointed out that the flip-flop circuit $F_b$ is still set so that a logic O-signal appears at the output of the NAND-circuit $N_b$ after a timing signal T appears. This causes the flip-flop circuit $F'_b$ to be set so that a code signal $B_1$ appears. The flip-flop circuit $F'_a$ is simultaneously reset so that a logic O-signal appears at its output.

If a code signal C occurs, a logic O-signal will appear at the output of the inverter $I_c$. The flip-flop circuit $F_b$ is therefore reset or driven to cut-off so that a logic O-signal appears at its output. The flip-flop circuit $F_a$ is simultaneously again prepared or set so that a logic 1-signal appears at its output. It should be pointed out that the flip-flop circuit $F_c$ remains set so that a logic 1-signal appears at its output. If a timing signal T then occurs, a logic O-signal will appear at the output of the NAND-network $N_c$ so that the flip-flop circuit $F'_b$ is reset. The flip-flop circuit $F'_c$ is also set so that the code signal $C_1$ appears at its output.

If a code signal A again occurs, the flip-flop circuit $F_b$ is set and the flip-flop circuit $F_c$ is reset; the flip-flop circuit $F_a$ remains set. If a timing signal T then occurs, a logic 1-signal will appear at the output of the NAND-network $N_a$, the flip-flop circuit $F'_a$ will be set and the code signal $A_1$ will appear at its output. The flip-flop circuit $F'_c$ is simultaneously reset.

If an oscillating motion occurs on the knitting machine or on the needle cylinder when the circular knitting machine is shut down, such oscillating motions must not call up any further pattern instructions from a store but the last correctly called up pattern data must be retained. This requirement is satisfied by the partial circuit according to FIG. 7 as is disclosed by the following example:

The code signal $A_1$ appears at the output of the flip-flop circuit $F'_a$ after the appearance of the code signal A. If the circular knitting machine continues to operate correctly, this is followed by a code signal B, with the result that a code signal $B_1$ appears at the output of the flip-flop circuit $F'_b$ while a logic O-signal appears at the output of the flipflop circuit $F'_a$. If the circular knitting machine were to swing back on being decelerated, the code signal B would not be followed by the code signal C but by the code signal A so that a logic O-signal appears at the output of the inverter $I_a$. However, the flip-flop circuit $F_a$ cannot be set with the result that the NAND-network $N_a$ does not alter its output signal.

The flip-flop circuits $F_a$, $F_b$ and $F_c$ therefore interlock each other mutually and their states can be altered only if the code signals A, B and C occur in the correct sequence. Moreover, the flip-flop circuits $F'_a$, $F'_b$ and $F'_c$ store the last correctly called-up pattern data which is retained until the code signal A or B or C appears in the correct sequence. No damage therefore results in the described embodiment if the needle cylinder swings back by up to two needle pitches.

The tracer element arrangement according to the invention will of course offer advantages not only in the case of pattern control means of circular knitting machines in which each knitting system is provided with a plurality of control units for controlling the selector elements such as the needles, because call up of pattern data in the correct sequence can also be ensured in other circular knitting machines by a tracer element which produces a timing signal in co-operation with further tracer elements which produce code signals in a cyclic sequence.

We claim:

1. In a circular knitting machine having a plurality of knitting systems and a first stationary part and a second part rotatable relative to said first stationary part, an improved arrangement for producing synchronization pulses for pattern control, the improvement comprising a plurality of different types of selector elements which are mounted one after the other equidistantly according to a pitch of one of said parts and in cyclical sequence in the rotary direction of said part, and a plurality of control units for controlling the selector elements, said control units being mounted on the other one of said parts and being adapted to receive pattern command signals in accordance with a preselected pattern, the number of control units per knitting system being equal to (*n*) which corresponds to the number of different selector elements, a raster system operatively mounted on one of said parts and having first and second rasters, said first raster having a pitch equal to the pitch of said one of the parts and the second raster having a pitch equal to that of the first raster divided by the number (*n*) of different types of selector elements, pick-up means operatively mounted on the other machine part, said pick-up means including a first pick-up element which scans said first raster and produces a series of clock signals in accordance with such scanning, and second pick-up elements arranged one behind the other in a row extending in the rotary direction for scanning said second raster to produce a series of code signals, in accordance with such scanning, the number of second pick-up elements corresponding to the number (*n*) of different types of selector elements, and gate means for combining the series of code signals with the series of clock signals, said first and second pick-up elements being mounted on a common support which is secured to said other machine part and is adjustable in the rotary direction.

2. Circular knitting machine according to claim 1, characterized in that the first raster is formed by a ring of slots which extend approximately perpendicularly to the direction of rotation, that each $n^{th}$ slot is longer than the slots disposed therebetween and the totality of the said $n^{th}$ slots forms the second raster.

3. Circular knitting machine according to claim 2, characterized in that said other machine part is that first stationary part such that said pick-up elements are stationary and said one part is said second rotatable part which is a ring plate.

4. Circular knitting machine according to claim 3, characterized in that the ring plate is rigidly connected to a needle cylinder.

5. Circular knitting machine according to claim 1, characterized in that said raster system forms a surface and the support is adjustable and rotatable about an axis which extends approximately perpendicularly from the surface formed by the raster system.

6. Circular knitting machine according to claim 1, characterized in that the support is a rod on one of whose end faces the pick-up elements are mounted.

7. Circular knitting machine according to claim 6, characterized in that the pick-up elements are constructed in a known manner as field plates, more particularly as differential field plates which are disposed on at least one permanent magnet.

8. Circular knitting machine according to claim 6, characterized in that said one endface on which the pick-up elements are mounted is provided with a step which functions as abutment for the permanent magnets.

9. Circular knitting machine according to claim 7, characterized in that the rod is provided with a longitudinal bore for accomodating connecting leads.

10. Circular knitting machine according to claim 8, characterized in that the tracer elements are embedded in an embedding compound, more particularly in encapsulating resin, and that said member formed by this compound is flush with an end face region that adjoins the step.

11. Circular knitting machine according to claim 7, characterized in that at least one permanent magnet contains rare earths and are constructed more particularly as cobalt-samarium magnets.

* * * * *